United States Patent [19]

Mester

[11] 4,333,011

[45] Jun. 1, 1982

[54] X-RAY GENERATOR FOR FAST DOSE RATE CONTROL

[75] Inventor: Heinz Mester, Hamburg, Fed. Rep. of Germany

[73] Assignee: U.S. Philips Corporation, New York, N.Y.

[21] Appl. No.: 145,646

[22] Filed: May 2, 1980

[30] Foreign Application Priority Data

May 2, 1979 [DE] Fed. Rep. of Germany ..... 2917636

[51] Int. Cl.[3] ..... H05G 1/30

[52] U.S. Cl. ..... 250/409; 250/408; 250/402

[58] Field of Search ..... 250/402, 403, 404, , 250/409, 408

[56] References Cited

U.S. PATENT DOCUMENTS 3,911,273 10/1975 Franke ..... 250/409

*Primary Examiner*—Bruce C. Anderson

*Attorney, Agent, or Firm*—Robert T. Mayer; Bernard Franzblau

[57] ABSTRACT

An X-ray generator comprising two high voltage generators which supply a positive and a negative potential to the anode and cathode, respectively, of an X-ray tube. The high voltage generator connected to the cathode is connected in series with a grid-controlled electron tube. The X-ray tube has a grounded electrode between its anode and cathode. If the grid voltage of the electron tube is changed so that the anode potential decreases, then there is an increase in the X-ray tube voltage and an increase in the voltage between the anode and electrode of the X-ray tube, thus increasing the tube current. Tube current and voltage are thus varied in the same sense by modifying the grid voltage, thus producing a fast dose rate control.

9 Claims, 1 Drawing Figure

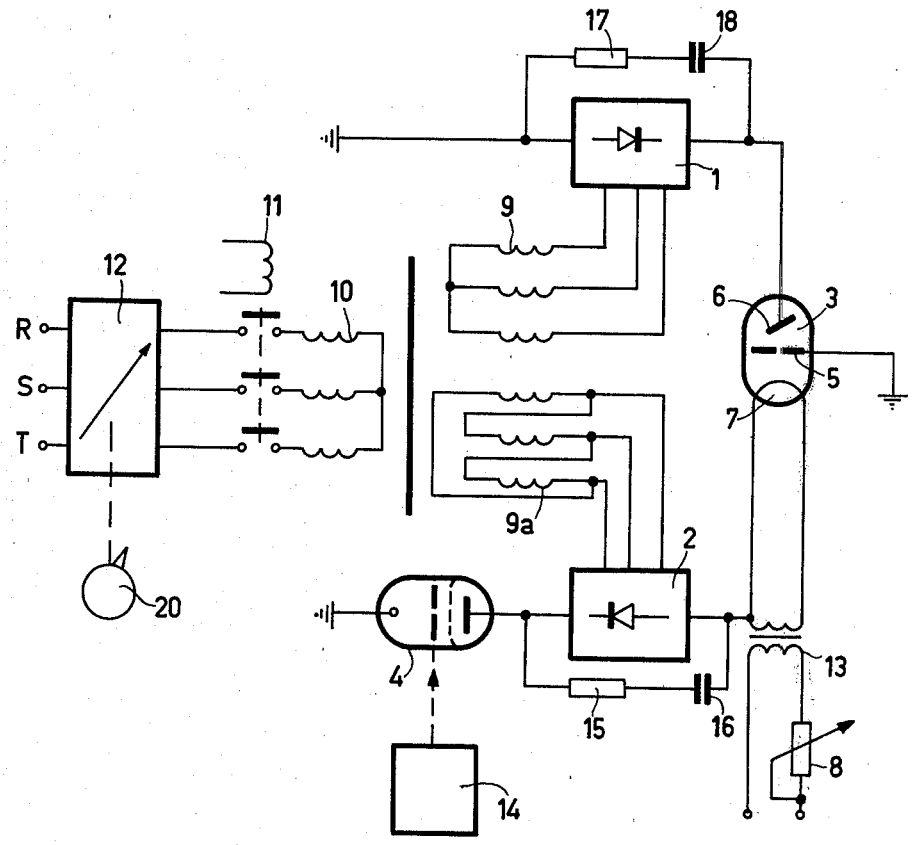
17
18
1
11
9
12
10
6
3
R
S
T
5
7
9a
2
20
4
13
15
16
8
14

X-RAY GENERATOR FOR FAST DOSE RATE CONTROL

The invention relates to an X-ray generator comprising a first high voltage generator connected to the anode of an X-ray tube and supplying a positive high voltage relative to a reference voltage, and a second high voltage generator connected to the cathode of the X-ray tube and supplying a negative high voltage relative to the reference voltage, said second high voltage generator being connected in series with a grid-controlled electron tube.

Such an X-ray generator has already been described in U.S. Pat. No. 3,991,315. The known X-ray generator permits fast dose rate control during exposure. Like the well-known X-ray generators that employ two grid-controlled electron tubes ("Electromedica" 4-5/1973, pages 177 ff), it has the disadvantage that by varying the grid voltage of the electron tube it is only possible to modify the voltage at the X-ray tube, but the current flowing through the X-ray tube is hardly modified at all. Because, however, the voltage at an X-ray tube determines the quality of the image of an X-ray exposure, the quality of the image varies considerably with the dose rate.

X-ray generators are also known that have an X-ray tube fitted with a control grid, whereby the current through the X-ray tube can be varied very rapidly by changing the grid voltage. Normally, this is possible only for small, and medium dose rates. There is also the added disadvantage that because of the far from negligible internal resistance of the high voltage generator, the tube voltage is, of necessity, modified if the current is changed, and in the opposite direction. This means that if the current increases, the tube voltage will reduced—and vice versa—so that the effects of these two changes on the dose rate partially offset one another.

It is an object of the present invention therefore to provide an X-ray generator that enables a rapid change to be made in the dose rate by a unidirectional change in tube current and tube voltage (tube voltage and tube current should therefore be either increased or decreased simultaneously). An X-ray generator according to the invention is characterized in that the X-ray tube is provided with an electrode between the anode and cathode, the electrode being connected to the reference voltage.

An X-ray tube with an electrode between the anode and cathode that carries approximately half the tube voltage with respect to the anode and cathode has been described in British Pat. No. 839 945. This electrode has an aperture in its centre to enable the electron beam emitted from the cathode to pass through and functions to prevent secondary electrons from impinging upon the glass tube envelope and also isolate the anode and cathode spaces from one another. Such an electrode, however, is also useful for X-ray tubes in a metal envelope as is described, for example, in U.S. Pat. No. 4,024,424. Here the electrode is designed in such a way that secondary electrons reflected at the anode cannot pass the cathode head and reach the cathode insulator. The aperture is so narrow that the electrons reflected at the anode can in fact impinge on the cathode head, but cannot pass by this to reach the space on the other side (with respect to the anode) of the cathode head.

If, in the X-ray generator of the present invention, the grid potential of the grid-controlled electron tube is modified, then the cathode voltage of the X-ray tube changes and with it also the voltage of the X-ray tube and the grid-cathode voltage and this means that the tube current is changed unidirectionally with the tube voltage. If, for example, the grid of the electron tube is made more negative, then the voltage across the electron tube and the voltage at the cathode of the X-ray tube and with it the tube voltage decrease by the same amount. The reduction in the voltage at the cathode of the X-ray tube, which has the effect of making the cathode voltage more positive, has the same effect as shifting the potential at the electrode of the X-ray tube to a more negative value: the space charge between the electrode and the cathode is increased so that the current through the X-ray tube also decreases. This change in the tube voltage and tube current with the voltage change of the grid of the electron tube is practically instantaneous.

One embodiment of an X-ray generator according to the invention is characterized in that the cathode of the grid-controlled electron tube is connected to a reference potential. This provides the advantage that the voltage between the (grounded) reference point and the grid of the electron tube may be relatively small so that the control circuit that modifies the grid potential of the electron tube can have a relatively simple construction.

If the grid potential of the grid-controlled electron tube is made sufficiently negative, the current through the X-ray tube can be interrupted completely and instantaneously. This almost instantaneous switching off of the dose rate is advantageous for the automatic exposure system and for all forms of rapid series and cinematic exposures. One disturbing effect of this fast switching, however, is that energy is stored in the transformer cores that are always needed to generate the high voltage. Thus, when there is a rapid change in the current flow—the primary voltage is simultaneously disconnected—this energy causes surges. In a further embodiment of an X-ray generator according to the invention these surges are eliminated by connecting an RC element in parallel with each of the high voltage generators.

Another embodiment of an X-ray generator according to the invention ensures that the high voltage delivered by the second high voltage generator is greater in magnitude than the high voltage delivered by the first high voltage generator, preferably by an amount of approximately 15%. This has the result that even with very low voltages at the X-ray tube the potential between grid and cathode is still sufficiently high to prevent substantial space discharge effects.

The invention will be explained in greater detail below with the aid of the accompanying drawing which illustrates a circuit diagram of an exemplary embodiment of an X-ray apparatus according to the invention.

The drawing shows an X-ray tube 3 which between anode 6 and cathode 7 has a grounded electrode 5 with an aperture for the electron beam emitted by the cathode 7, which serves to prevent the electrons reflected from the anode 6 passing by the cathode 7 to reach the space beyond the cathode 7. Such an X-ray tube 3 has an anode penetration factor which is considerably smaller than 1 and, up to a voltage of 50 kV between electrode 5 and cathode 7, its tube current is limited by space charge effects.

The anode 6 of X-ray tube 3 is connected to one pole of a rectifier bridge 1, the other pole of which is connected to ground and which delivers a variable positive high voltage between +20 kV and +75 kV. The cathode 7, whose heating current can be generated by means of a heating transformer 13 and can be adjusted by a variable resistor 8, is connected to the negative pole of a second rectifier bridge 2 whose positive pole is connected to the anode of a switching and regulating tetrode 4 having its cathode connected to ground. The control grid of the regulating tetrode 4 is connected to a control voltage generator 14. The tube voltage delivered by the high voltage generator 2, 9a may also be adjustable and may be of at least the same magnitude as the voltage delivered by the high voltage generator 1,9. High voltage generators 1,9 and 2, 9a contain, preferably, three-phase bridge rectifiers 1,2 which are connected to the star- or delta-connected secondary windings 9 or 9a of a high voltage transformer which has a common star-connected primary winding 10 for the two three-phase secondary windings 9 and 9a. The three-phase primary winding 10 is connected via a set of contacts 11 to a schematically illustrated regulating transformer 12 with the aid of which it is possible to adjust the primary voltage manually (rotary knob 20). The outputs of the three-phase bridge rectifiers 1 and 2 are bridged to ground by the series connection of a resistor 17 and capacitor 18 and a series connection of a capacitor 15 and a resistor 16 respectively so that in the event a negative potential is applied to the grid of the regulating tetrode 4 and thus the X-ray tube current is abruptly switched off, the energy stored in secondary windings 9 or 9a can be dissipated.

When a tomograph is being prepared, for example, with a tube voltage of 80 kV, the X-ray generator described can be operated approximately as follows:

Using rotary knob 20 the user sets the voltage (e.g. 80 kV) which he considers the most suitable for the exposure that is to be made. The voltage setting may be coupled to the heating current setting in such a way that the set voltage is fed with a current at which only a fraction of the load capacity of the X-ray tube 3 is utilised. The three-phase voltage transformer 9, 9a, 10 is designed in such a way that with the desired current at the outputs of the three-phase bridge rectifiers 1 and 2, a high voltage is generated that is higher by a given amount, e.g. 20 kV, than the set tube voltage. The bias voltage at the control grid of the regulating tetrode 4 is dimensioned in such a way that the voltage drop between the anode and cathode of the regulating tetrode 4 corresponds exactly to this given amount (20 kV). The cathode 7 of X-ray tube 3 then carries the potential −30 kV whereas the anode carries the potential +50 kV so that there is a total of 80 kV present at the X-ray tube 3. The dose rate behind an irradiated object is then detected by a measuring element (not illustrated in detail here) and compared with a given set point value whereby, from the difference in, the control voltage generator 14 derives a control voltage which is superimposed on the bias voltage. If, for example, the dose rate generated with the setting selected initially is too high, then the voltage at the control grid of the regulating tetrode 4 is made more negative as a result of which the voltage drop across the regulating tetrode increases, and the negative high voltage at the cathode 7 of X-ray tube 3 decreases. This brings about a simultaneous drop in tube current and tube voltage, as already explained, so that the dose is also reduced.

If the dose rate produced at the beginning is to be increased, the voltage at control grid 4 is made more positive, so that the cathode voltage of X-ray tube 3 becomes more negative. This causes the tube voltage and tube current to increase so that care should be taken that there is no overloading. For this purpose it is possible, in a known manner, to determine the anode power of the X-ray tube by simultaneous detection of tube voltage and tube current and, by multiplication of these quantities, this can be used for overload protection.

It is also possible to operate the X-ray tube 3 at the beginning of an exposure so that full use is made of the tube power. The initial values of tube voltage and tube current must be selected in such a way as to ensure that the necessary dose rate is available. In this case an increase in the dose rate is excluded, and the voltage drop between cathode and anode of the regulating tetrode 4 can be set as low as possible (1 kV or less). This has the advantage that the sum of the high voltages produced at the outputs of the three-phase bridge rectifiers 1 and 2 corresponds in practice to the set tube voltage. If the exposure is then initiated (by closing the switch 11 in the line of primary winding 10) and too high a dose rate is obtained, then a control voltage is produced from the correcting signal in the control signal generator 14 that corresponds to the dose rate deviation. This control voltage causes instantaneously increase of the voltage drop across the regulating tetrode until such time as the dose rate reaches its desired value. After the exposure has been made, the potential of the control grid need only be given such a negative value and the voltage drop at the regulating tetrode 4 need only be increased so that the bias voltage between electrode 5 of the X-ray tube 3 and cathode 7 assumes a value at which, because of the space charge that is then produced, the flow of current is prevented by the X-ray tube 3. At the same time, the voltage on the primary side of the three-phase transformer 9, 9a, 10 is then also switched off by opening switch 11.

If, in the case of very small tube voltages, e.g. 45 kV, the cathode potential has the same magnitude as the anode potential (in the assumed example therefore 2.5 kV) so that the voltage between the electrode 5 and cathode 7 of X-ray tube 3 is correspondingly low (22.5 kV) it may happen that the space charge effects in the area between electrode 5 and cathode 7 are so pronounced that sufficient tube current can no longer flow. To remedy this it is recommended that the secondary winding 9a of the three-phase transformer that feeds the three-phase rectifier bridge 2 which generates the cathode potential for the X-ray tube 3 should be designed in such a way that the voltage generated by it is, say, 15% greater than the voltage generated by the secondary winding 9 of the three-phase transformer, said voltage being fed to the cathode 7 of X-ray tube 3. In this case, with a tube voltage of 45 kV the cathode potential would be approximately −24.1 kV and the anode potential approximately 20.9 kV.

In principle it would also be possible to design the X-ray generator in such a way that there is present at the output of the three-phase bridge rectifier 2 a constant voltage that corresponds to half the maximum value of the tube voltage of, for example 150 kV, that is to say 75 kV. When the regulating transformer 12 is adjusted, then only the anode potential changes. For the cathode potential to be also changed, the adjusting knob 20 has to be coupled to the control voltage generator 14 so that the cathode potential shifts in the same direction as the anode potential-to a lower limit of, for example, −30 kV. This solution with a contant high voltage at the output of the three-phase bridge rectifier 2 has, of course, the disadvantage that for supplying three-phase transformer 9a there would have to be a separate three-phase primary winding which could be connected, for example, to the RST terminals and in whose supply lines there would also need to be a switch to disconnect the low frequency of the primary winding.

What is claimed is:

1. An X-ray generator comprising an X-ray tube including an anode, a cathode and an electrode between the anode and cathode, first and second high voltage generators each of which comprises a high voltage transformer winding and rectifying means, means connecting the first high voltage generator to the anode of the X-ray tube to supply thereto a positive high voltage, means connecting the second high voltage generator to the cathode of the X-ray tube to supply thereto a negative high voltage, means connecting said electrode of the X-ray tube to a source of reference voltage which is intermediate in value the anode and cathode voltages of the X-ray tube, and a grid-controlled electron tube connected in series with the second high voltage generator and with its cathode connected to the source of reference voltage whereby a change in the grid voltage of the electron tube produces a simultaneous change in the X-ray tube voltage and current and in the same sense.

2. An X-ray generator as claimed in claim 1 further comprising an RC element connected in parallel with each of the high voltage generators.

3. An X-ray generator as claimed in claim 1 wherein the high voltage supplied by the second high generator is of a higher magnitude than that supplied by the first high voltage generator.

4. An X-ray generator as claimed in claim 1 wherein the second high voltage generator supplies a high voltage of approximately 15% higher magnitude than the high voltage supplied by the first high voltage generator.

5. An X-ray generator comprising, an X-ray tube including an anode, a cathode and a control electrode, first and second high voltage generators each of which comprises a high voltage transformer winding and rectifying means, a grid-controlled electron tube, means connecting the first high voltage generator, the X-ray tube, the second high voltage generator and the electron tube in series circuit so that the first high voltage generator supplies a high positive voltage to the X-ray tube anode and the second high voltage generator supplies a high negative voltage to the X-ray tube cathode, means connecting the control electrode of the X-ray tube to a source of fixed reference voltage, and means coupling the grid of the electron tube to a source of control voltage and a cathode of the electron tube to a source of reference voltage so that a change in the grid voltage of the electron tube produces a change in the X-ray tube voltage and current in the same sense.

6. An X-ray generator as claimed in claim 5 further comprising means for manually adjusting the voltage level of at least one of said high voltage generators and independently of said grid-controlled electron tube.

7. An X-ray generator as claimed in claim 5 wherein said source of fixed reference voltage comprises circuit ground and wherein the cathode of the electron tube is directly connected to said circuit ground.

8. An X-ray generator as claimed in claims 5 or 7 wherein said source of control voltage supplies a control voltage that is determined by the radiation dose of an object irradiated by the X-ray tube.

9. An X-ray generator as claimed in claim 5 further comprising a regulating transformer for supplying an adjustable voltage to the transformer winding of at least one of said high voltage generators, and means separate from said electron tube for manually adjusting the voltage of the regulating transformer and thus the voltage level of said one high voltage generator to a value related to the desired operating voltage of the X-ray tube for a given exposure.

* * * * *

UNITED STATES PATENT AND TRADEMARK OFFICE

CERTIFICATE OF CORRECTION

PATENT NO. : 4,333,011

DATED : June 1, 1982

INVENTOR(S) : HEINZ MESTER

It is certified that error appears in the above-identified patent and that said Letters Patent is hereby corrected as shown below:

In the Claims:

Claim 3, line 2, after "high" (second occurence) insert --voltage--

Signed and Sealed this

*Seventh* Day of *May 1985*

[SEAL]

*Attest:*

DONALD J. QUIGG

*Attesting Officer*

*Acting Commissioner of Patents and Trademarks*